United States Patent [19]

Issler et al.

[11] 4,167,171

[45] Sep. 11, 1979

[54] POSITIVELY LUBRICATED DISTRIBUTOR CONSTRUCTION FOR INTERNAL COMBUSTION ENGINES

[75] Inventors: Jörg Issler, Stuttgart; Helmut Funke, Korntal-Münchingen; Klaus Schmidt, Schwieberdingen, all of Fed. Rep. of Germany

[73] Assignee: Robert Bosch GmbH, Stuttgart, Fed. Rep. of Germany

[21] Appl. No.: 804,772

[22] Filed: Jun. 8, 1977

[30] Foreign Application Priority Data

Jul. 6, 1976 [DE] Fed. Rep. of Germany ..... 2630220

[51] Int. Cl.[2] ..... F01M 1/26

[52] U.S. Cl. ..... 123/196 R; 123/146.5 A; 123/198 DA

[58] Field of Search ..... 184/6.18, 6.5, 6.26; 200/27 A; 123/196 R, 196 S, 146.5 A, 196 W, 198 DA, 195 A

[56] References Cited

U.S. PATENT DOCUMENTS

| | | | |
|---|---|---|---|
| 1,397,941 | 11/1921 | Wright | 123/146.5 A |
| 1,405,724 | 2/1922 | Smith | 123/146.5 A |
| 1,660,599 | 2/1928 | Davenport | 123/196 R |
| 1,683,376 | 9/1928 | Williams et al. | 123/146.5 A |
| 1,779,912 | 10/1930 | MacPherson | 123/195 A |
| 2,226,596 | 12/1940 | Swenson | 123/195 A |
| 2,665,122 | 1/1954 | Rowland | 184/6.18 X |
| 2,731,008 | 1/1956 | Porsche et al. | 123/195 A |
| 2,981,194 | 4/1961 | Bettoni | 123/195 A X |
| 2,986,433 | 5/1961 | Herrmann | 60/39.08 X |
| 3,659,674 | 5/1972 | Ferrario | 184/6.26 X |
| 3,923,028 | 12/1975 | Campbell et al. | 123/146.5 A |
| 3,989,023 | 11/1976 | Florio et al. | 123/146.5 A |

FOREIGN PATENT DOCUMENTS

| | | | |
|---|---|---|---|
| 2362763 | 12/1973 | Fed. Rep. of Germany | 123/146.5 A |

*Primary Examiner*—David H. Brown

*Attorney, Agent, or Firm*—Frishauf, Holtz, Goodman & Woodward

[57] ABSTRACT

To provide for extended true running of the distributor shaft and prevent wear on relatively movable mechanical components within the distributor, such as a shaft and bearings, a centrifugal spark advance/retard mechanism, or the like, the relatively movable parts are included in the lubricating circuit of the engine, for example by being connected to the pressure lubrication system of the engine or located to be exposed to oil mist in the engine compartment and arising upon operation of the engine, so that the relatively movable parts are constantly lubricated by the engine lubricating system.

9 Claims, 4 Drawing Figures

POSITIVELY LUBRICATED DISTRIBUTOR CONSTRUCTION FOR INTERNAL COMBUSTION ENGINES

The present invention relates to a distributor for externally ignited internal combustion engines, for example of the automotive type, and more particularly to a distributor construction in which the distributor is secured to the engine block and has a distributor shaft driven from a shaft of the the engine. The distributor may, additionally, drive a transducer to provide an electrical signal pulse to initiate or control an ignition event.

The shaft of ignition distributors is usually journalled in upper or lower bearings. The lower bearing is generally attached to a cylindrical element forming part of the housing of the distributor or attached thereto; the upper bearing is likewise located on the distributor cyclindrical element or in a bearing holder, such as a plate, a spider, or the like/which is, in turn, secured to the housing of the distributor. It has recently been proposed to use bearings of the permanently lubricated type, that is, sinter-type bearings, which have a bearing material providing permanent lubrication. The shaft is thus lubricated within its bearing bushings or bearing structure without requiring additional lubrication for long periods of time.

Increasingly severe requirements to reduce the emission of noxious components from internal combustion engines requires accurate timing of the ignition event. Accuracy of timing, in turn, requires true running of the distributor shaft. Practically no tolerance is permitted in the accuracy of the timing of the ignition shaft throughout the lifetime of the engine and, in order to prevent variations in the accuracy of ignition timing, play in the bearings, and particularly in the upper bearing, must/be effectively prevented.

SUBJECT MATTER OF THE PRESENT INVENTION

It is an object of the present invention to provide a distributor construction in which the accuracy of guidance, and the true running of the distributor shaft is ensured over extended periods of time, typically the life of the engine with which it is associated.

To accomplish the object, the lubrication system of the engine itself is hydraulically connected to those mechanical portions of the distributor which are subject to wear so that forced lubrication derived from the engine is applied to bearings of the distributor and prevent wear thereon and thus loss of accuracy in true running of the bearing shaft, or oil mist, derived from the mist lubrication system of the engine, where oil is thrown about, is conducted to those part subject to wear.

The present invention is based on the principle that the bearings for the distributor should be lubricated throughout the entire operating time of the engine and with the same reliability as engine lubrication with engine lubricating oil in order to prevent wear on the rubbing surfaces of the bearings, or at least substantially reduce such wear to increase the duration of true running of the distributor shaft.

It has previously been proposed to provide an oil supply coupled to magneto ignition systems, in which a central oil tank, preferably at an elevated level, is supplied with oil ducts to various lubricating points. It has also been proposed to provide a lubricating system for the armature shaft of an ignition magneto in which an oil-soaked felt ring is included in the bearing bushing, and an oil supply provides oil to the bearing bushing. In such a construction, the oiler is located outside of the distributor housing and includes an arrangement in which oil is supplied in drops through a duct, such as a groove, to the felt ring.

The oil supply systems above referred to were suitable for the ignition systems at the time when they were proposed; they are not suitable, however, for high-speed long-time duration as required by current modern internal combustion engines and their ignition systems.

DRAWINGS, illustrating an example:

Figure 4:
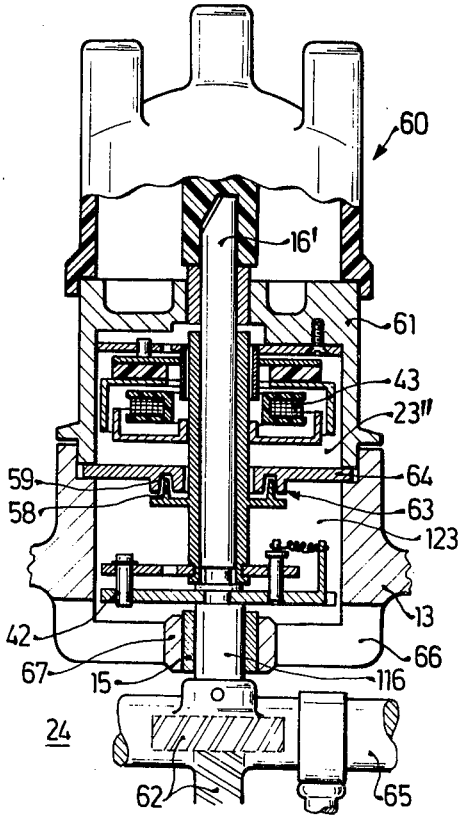

and FIG. 4 is a longitudinal fragmentary axial view through a distributor and ignition signal generator showing yet another arrangement.

An ignition distributor 10, shown schematically and only in fragmentary form to illustrate the principle of the invention, has a housing 11 which terminates in a cylindrical, shaft-like structure 12 which is secured by means of a flange to the motor block 13. Two bearing bushings 14, 15 are pressed into the cylindrical or shaft-like portion of the housing 11 of the distributor. The bearing bushings 14, 15 form the bearings for the distributor shaft 16. The forced lubricating system of the engine is schematically shown by the engine oil pump 17 with distributing ducts 18 leading to various lubricating points in the engine.

In accordance with the present invention, the bearing bushings 14, 15 are force-lubricated from the forced lubricating system of the engine and, thus, are connected to one of the forced lubricating ducts 18 which have pressurized oil applied thereto, derived from pump 17. Thus, in operation of the engine, the bushings 14, 15 are constantly wetted by oil. A duct 19, secured laterally to the cylindrical portion 12 of the distributor 11, is connected to the forced lubricating system. The duct 19 terminates in a ring-shaped pressurized lubricant distributor chamber 20 which, at its ends, is closed by the bearing bushings 14, 15. An opening 21 in the cylindrical portion 12 connects the duct 19 with the ring-shaped chamber 20. Any excess oil can drip from the bearing bushing 15 back into the engine compartment 24.

Figure 2:
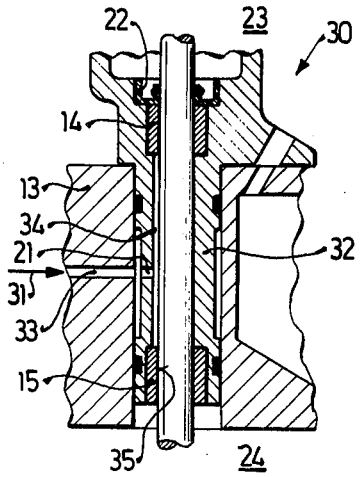
FIG. 2 is a fragmentry axial sectional view showing another embodiment of the oil supply to the bearings.

Embodiment of FIG. 2: A distributor 30 has a cylindrical portion 32 secured to motor housing 13 for example by a flange or screw connection. Arrow 31 schematically shows connection to the lubricating system of the engine. A groove 34 communicates with duct 33 through opening 21 in the cylindrical portion 32 of the distributor housing.

Figure 1:
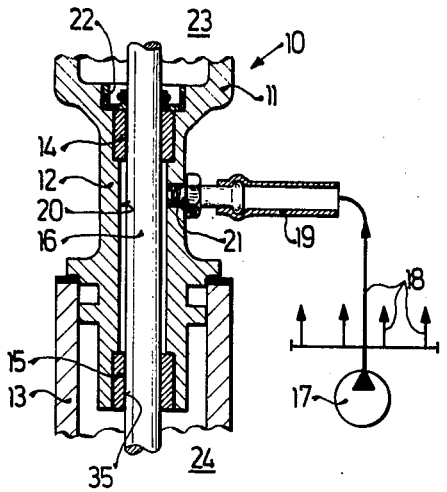
FIG. 1 is a fragmentary axial sectional view through the lower portion of a distributor housing showing the bearing arrangement for the distributor shaft, and the oil supply therefor, in schematic representation.

In the embodiments of FIGS. 1 and 2, the bearings 14, 15 of the distributor 10, 30, respectively, have oil supplied thereto under pressure, which is supplied either to the ring-shaped chamber 20 or to the groove 34, respectively. A seal 22 prevents penetration of oil from bearing 14 into the interior 23 of the distributor. The oil may, however, drip through the bearing surface 35 of the lower bearing 15 and run off into the engine compartment 24.

Figure 3:
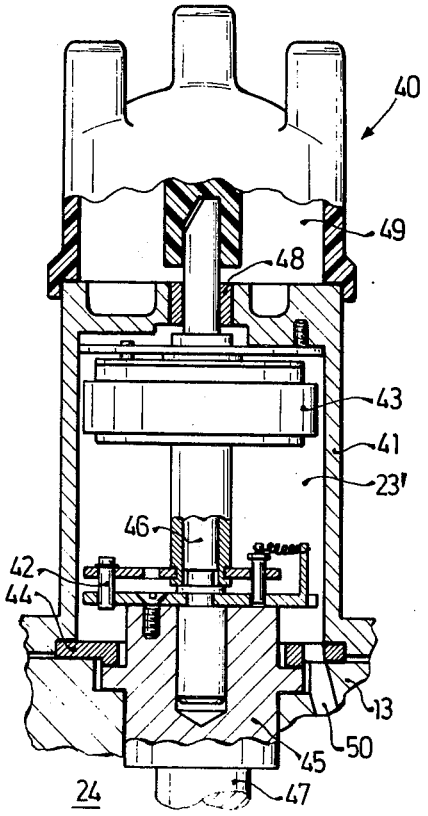
FIG. 3 is a fragmentary, part-sectional axial view through a distributor—contactless ignition signal transducer combination.

Embodiment of FIG. 3: An ignition distributor 40 has a shaft 46 which is journalled in the bearing portion 45 of the engine cam shaft 47. Bearing 45 is supported on a δ shoulder of motor block 13, and held in position by sealing ring 44. The two bearing bushings 14, 15 used in the embodiments of FIGS. 1 and 2 are not need in this construction. Housing 41 of the distributor 40 is connected to the engine housing 13 by means of a flange. The housing also secures the distributor bearing ring 48 to provide axial clamping force to the bearing ring 48 with respect to the engine cam shaft 47. The sealing ring 44 is interposed between the flange of the distributor and the engine housing 13. The side of the housing 41 remote from the engine forms an essentially closed surface; the distributor shaft 46, secured to centrifugal timing adjustment plate 42 is carried through the sealing and bearing ring 48 to the high-tension portion of the distributor to seal the high-tension chamber 49 with respect to the lower part of the distributor housing 41.

Shaft 46 rotates with shaft 47, but is phase adjustable with respect thereto by the centrifugal timing adjustment plate 42. Lubricant is supplied to the bearing portion 45 as oil mist through opening 50. Oil being thrown off by the plate 42 in chamber 23' of the distributor 40 to provide an oil mist or oil wetting for the centrifugal timing adjustment system 42 and for the transducer 43. The centrifugal spark advance—retard system itself is well known and may be of any standard construction. The opening 50 also provides for return flow of that oil back into the engine compartment 24 which does not pass by the bearing portion 45.

Embodiment of FIG. 4: The distributor 60 has a shaft 16' which is arranged at right angles to the cam shaft 65 of the engine. The shaft 116 is driven over gears 62. Housing 61 of the distributor 60 is connected to the engine block by means of a flange. A sealing plate 64 separates the interior chamber 23'' of the distributor—breaker structure from the portion 123 in which the centrifugal spark advance—retard mechanism 42, connecting shafts 116 and 16' are located. A labyrinth 63, formed of a groove 59 and a projection 58 projecting from shaft 16', prevents penetration of oil into chamber 23''. Two arms 66 extending from the interior of the engine housing 13 hold a sleeve 67 in position in which bearing bushing 15 is press-fitted the arms forming an open structure bearing support. The openings between the arms 66 provide communication with the interior 24 of the engine compartment and permit penetration of oil from the engine compartment to the portion 116 of the distributor in which the centrifugal spark advance—retard mechanism 42 is located.

Those portions which are subject to mechanical wear, such as, for example, the centrifugal timing adjustment system 42 and bearing 15, thus are wetted by the oil mist within the engine compartment 24 and thus lubricated. Excess oil flows back into the engine compartment 24.

In the embodiment of FIG. 3, likewise, the oil mist from the engine compartment 24 penetrates through opening 50 to provide an oil film and lubrication to the centrifugal timing system 42, excess oil dripping back into the engine compartment 24 through the opening 50. Oil may, also, be supplied through an external duct similar to ducts 19–21 (FIG. 1) to the chamber 23' (FIG. 3) to drip off through opening 50 into the engine compartment 24.

Various changes and modifications may be made within the scope of the inventive concept.

We claim:

1. In an internal combustion engine having a rotating shaft (47, 65), and an engine lubrication system which comprises an oil mist system providing oil mist in the engine compartment, a positively lubricated distributor comprising a housing (11, 41, 61) secured to the engine block (13) of the internal combustion engine, relatively movable components including a distributor shaft (16) within the housing driven from the rotating shaft (47, 65) of the internal combustion engine, wherein the distributor is connected to the engine to be in open fluid communication with the engine compartment to be exposed to the oil mist arising in the engine compartment during operation thereof and includes fluid connection means (50) in fluid communication with the lubricating system of the engine connected to movable components of the distributor subject to mechanical wear under relative movement.

2. Distributor according to claim 1, wherein (FIG. 3) the distributor (40) is formed with a chamber (23');

an ignition transducer (43) is located within said chamber;

said relatively movable part subject to wear comprises a centrifugal spark advance/retard adjustment mechanism (42), said mechanism (42) being located within the chamber (23');

and the fluid connection means include a communicating opening (50) formed in the engine block (13) and leading into said chamber (23') to provide for oil mist arising in operation of the engine to enter said chamber and through said opening in the engine block and hence to lubricate the components located within said chamber (23').

3. Distributor according to claim 2, wherein said opening (50) is located at the bottom of the chamber (23') to provide for run-off, under gravity, of excess oil collecting in the chamber.

4. Distributor according to claim 1, wherein a separating plate (64) is provided within the housing (61) of the distributor (60), the separating plate subdividing the interior of the housing into an upper chamber (23') and a lower chamber (123);

a centrifugal spark advance/retard mechanism (42) is located within said lower chamber (123);

a transducer system (43) is located within said upper chamber (23'');

said relatively movable parts comprise a stub shaft (116) driven from the engine and connected to said mechanism (42) and a bearing (15);

an open structure bearing support means (66) is provided supporting the bearing and forming said fluid connection means;

and said bearing support means (66) and said mechanism (42) are located relative to the engine block to be exposed to the oil mist arising upon operation of the engine.

5. Distributor according to claim 4, further comprising a labyrinth (58, 59) respectively connected to said separating plate (64) and the shaft (16') to prevent penetration of oil from the lower chamber (123) to the upper chamber (23') and through the separating plate, a portion of the labyrinth (58) being exposed to the oil mist from the engine compartment (24) of the engine and arising upon operation of the engine.

6. In an internal combustion engine having a roating shaft and an engine pressure lubricating system (17, 18), a positively lubricated distributor comprising a distributor housing (11,) secured to the engine block (13) of the internal combustion engine, relatively movable components including a distributor shaft (16) and bearings (14, 15) within the distributor housing, the distributor shaft being driven from the rotating shaft of the internal combustion engine;

and pressure lubricating fluid connection means (19, 21, 33) in fluid communication with the pressure lubricating system (18, 19) of the engine connected to and in fluid communication with the interior of said distributor housing and said distributor shaft and bearings to provide pressure lubrication thereto.

7. Distributor according to claim 6, wherein a pressurized lubricant distribution chamber (20) is formed in the distributor, the bearings (14, 15) being in pressure fluid communication with said chamber.

8. Distributor according to 7, wherein the distributor housing (11) is formed with a cylindrical extending portion (12), the pressurized lubricant distribution chamber (20) being located within said cylindrical projecting portion;

and the fluid connection means include a connecting duct line (19) communicating between said chamber (20) and the pressure lubricating system (17, 18) of the engine.

9. Distributor according to claim 7, wherein the distributor (11) is formed with a cylindrical projecting portion (32), said cylindrical projection portion extending within the engine block (13) of the engine;

and the fluid connection means includes a bore (33) formed in a motor block in communicating with the pressurized lubricant distribution chamber (34) to provide communication of the pressurized lubricant within the engine block of the engine into said chamber and hence provide pressurized lubricant to the distributor bearings (14, 15).

* * * * *